United States Patent [19]

Splitt

[11] Patent Number: 4,658,325

[45] Date of Patent: Apr. 14, 1987

[54] APPARATUS FOR PROVIDING POSITIVE PROTECTION FOR STATION PROTECTORS FOR TELEPHONE SYSTEMS

[75] Inventor: Frank G. Splitt, Mt. Prospect, Ill.

[73] Assignee: Northern Telecom Limited, Montreal, Canada

[21] Appl. No.: 725,471

[22] Filed: Apr. 22, 1985

[51] Int. Cl.[4] ..... H01T 4/06

[52] U.S. Cl. ..... 361/119; 292/307 R

[58] Field of Search ..... 292/307 R; 361/119, 361/331; 324/110; 200/43.22; 220/23.4, 248; 179/179, 184, 189 R

[56] References Cited

U.S. PATENT DOCUMENTS 1,179,648 4/1916 Personette ..... 292/307 R
4,405,967 7/1983 Cwirzen ..... 361/124
4,502,087 2/1985 Huvet ..... 361/119
4,533,971 8/1985 Smith ..... 361/119

*Primary Examiner*—Roy N. Envall, Jr.
*Assistant Examiner*—Howard L. Williams
*Attorney, Agent, or Firm*—Schwartz, Jeffery, Schwaab, Mack, Blumenthal & Evans

[57] ABSTRACT

A station protector, such as the type having pairs of arrestors positioned in adjacent wells, with screw cap enclosing the wells, is provided with positive protection by interconnecting a pair of screw caps by means which prevents turning of either screw cap, to provide access to a well, without breaking a connecting member and thus giving an indication of such turning, and access. The connecting member can be a bar attached to the screw caps, or cap member extending over the screw caps and connected to them. The cap members can be connected to the screw caps by bonding, crimping or other method.

24 Claims, 11 Drawing Figures

APPARATUS FOR PROVIDING POSITIVE PROTECTION FOR STATION PROTECTORS FOR TELEPHONE SYSTEMS

BACKGROUND OF THE INVENTION

1. Field of the Invention

This invention relates to providing positive protection for station protectors, as provided at premises of telephone systems users. Positive protection means some arrangement for either preventing unauthorized removal of or interference with an arrestor in the protectors or which will indicate if removal of, or some interference with, an arrestor has occurred.

2. Related Art

Conventionally, a protector module or assembly has two arrestors, one for each line of a pair entering a customer's premises, i.e. Tip and Ring. The module usually has wells into each of which an arrestor is positioned, held in place by a hexagon headed screw cap screwed into the top of the well. A connection to ground is provided, and in use, on the occurrence of a overvoltage, there is a spark breakdown across a gap in an arrestor to the ground. Removal of the arrestor, without replacement, leaves the line unprotected against overvoltage surges and the like.

It has been proposed to arrange contacts in a well which are held apart by the presence of an arrestor. However, if the arrestor is removed then the contacts connect and short the line to ground. In this condition, the telephone service is non-operative. By putting a non-conductive member into the well, such as a short length of wood, and replacing the screw cap, the contacts are opened and service is restored. However, there is no protection. Thus the safety feature is readily overcome, without any indication that tampering has occurred.

Other arrangements also exist for attempting to prevent operation of the service with unprotected lines, but it is generally readily possible to circumvent the safety precautions.

SUMMARY OF THE INVENTION

The present invention provides for the caps of a pair of protector wells in a protector to be interconnected in such a manner that any attempt, or actual achievement, to remove a screw cap for access to the arrestor, will be prevented, made extremely difficult, or, at the lowest level of safety, will indicate that removal or attempted removal has occurred. The invention is applicable to a wide variety of protectors and in particular is applicable to any multiple pair type of station protector.

The arrangement for providing this can vary considerably. A simple way is to weld or otherwise attach a rod or similar member across the tops of the caps, thus preventing turning of either cap. Another way is to fit a further cap over the screw caps of the protector, the further cap being attached to the screw cap by bonding, crimping or other means. The two further caps of a pair of wells are connected together to prevent turning of either cap. The connection can be strong enough to deter cutting or breaking, or be such that it can be broken but such breakage will then indicate some interference. A further arrangement is a unitary member fitting over both screw caps and attached thereto. Where individual caps are fitted over the screw caps, the individual caps can be connected together after application to the screw caps, or before, as required.

Thus, in its broadest aspect, the present invention provides apparatus for at least restricting access to an arrestor in a station protector comprising means interconnecting adjacent screw caps of a pair of protector wells in a protector, such means either preventing turning of either of the screw caps or indicating that such turning has occurred. The indication of turning is preferably obtained by breakage of an interconnecting member. The invention also includes a station protector incorporating such apparatus.

BRIEF DESCRIPTION OF THE DRAWINGS

The invention will be readily understood by the following description of certain embodiments, by way of example, in conjunction with the accompanying drawings, in which.

DETAILED DESCRIPTION OF THE INVENTION

Figure 1:
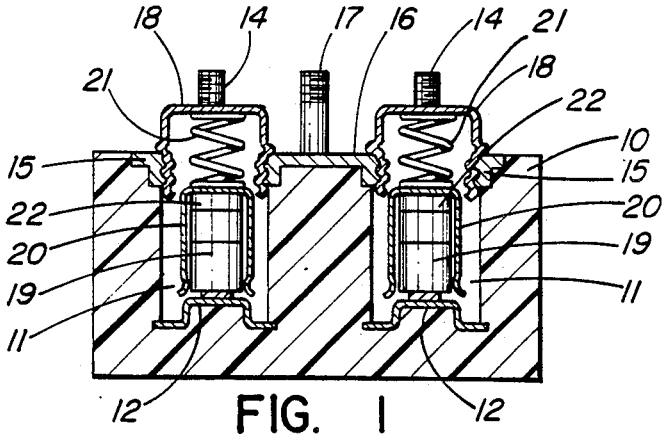
FIG. 1 (PRIOR ART)
FIG. 1 is a cross-section, on the line I—I of FIG. 2, through a conventional, known, protector.
Figure 2:
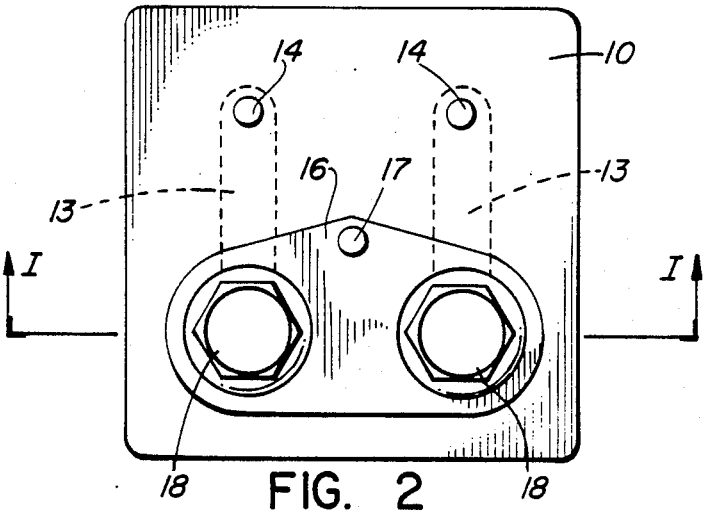
FIG. 2 (PRIOR ART)
FIG. 2 is a plan view of the protector in FIG. 1.

As illustrated in FIGS. 1 and 2, a known form of conventional protector, such as is used at a customer's premises, comprises a molded plastic housing 10 having two wells 11 extending down from a top surface. At the lower end of each well is a line contact member 12, for example, to metal strips 13 molded in the housing, the strips also being connected to line terminals 14 which extend above the housing. Connections are made to the line terminals 14 from the incoming telephone line to the customer, one being the Tip and the other Ring.

At the top of each well is an internally threaded bush or ring 15. The rings 15 are formed as part of a ground electrode 16, to which is also connected a ground terminal 17. A metal cap 18 screws into each ring 15. Within each well 11 is positioned an arrestor 19 positioned within a metal basket 20. A spring 21 extends between the top of the basket 20 and the cap 18. Between the top of each arrestor and the top of the associated basket is a fusible alloy disc 22.

This arrangement is conventional. The arrestor can be of varying form. Basically, the arrestor comprises two spaced electrodes defining a gap. One electrode is connected to the line contact member 12 and the other electrode is connected to the cap 18 and thus to ground, via the fusible alloy disc 22, basket 20 and spring 21.

In operation, if a high voltage occurs on a line, such as by a lightning strike or a power cable contacting a telephone line, a spark discharge occurs across the gap between the electrodes of an arrestor, discharging to ground. If a continuous, or at least a long term overvoltage occurs, the fusible alloy disc melts and the spring 21 pushes down the basket 20, the basket having fingers which move into contact with the line contact 12. This shorts out the telephone line to ground. In this condition, there is no service available.

A problem arises in that by unscrewing the cap 18, the spring 21, basket 20 and arrestor 19 can be removed and the cap then replaced. Telephone service is available but the line is not protected against overvoltage occurrences and damage to equipment can occur, often with serious consequences, such as a fire. It is not obvious from an external inspection that the line is unprotected.

Attempts have been made to overcome this problem by providing a spring contact, connected to or forming part of the line contact member 12, the spring contact, in a free position, making contact with a contact member connected to the ground electrode 16. On insertion of an arrestor, the spring contact is moved to prevent contact with the ground electrode. If the cap 18 is replaced without an arrestor in position, the telephone line is connected to ground, and is out of service. However, it has become realized that the safety feature can be overcome by replacing the arrestor with an insulating member such as a short piece of wood. In such an arrangement, there is no external indication that the protector has been tampered with.

The present invention provides, at the minimum, indication that tampering has occurred and can extend to the situation where considerable effort must be used and damage must be done to overcome the safety feature. In its broadest aspect, this is obtained by providing some means for interconnecting the caps of a pair of arrestor wells, to prevent relative rotation of a cap. If a cap is rotated relative to the other, this becomes visually observable.

Figure 3:
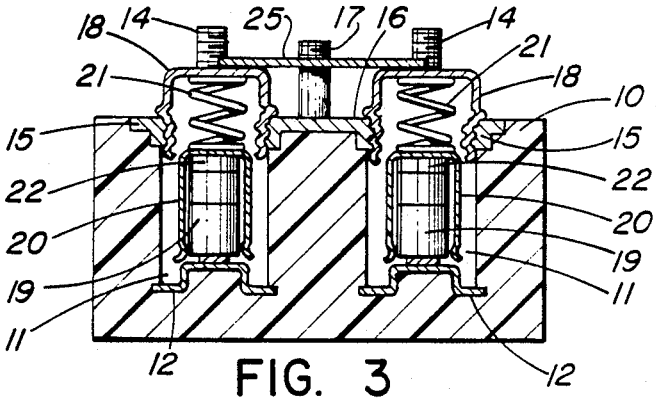
FIG. 3 is cross-section, similar to that of FIG. 1, illustrating one embodiment of the invention.
Figure 4:
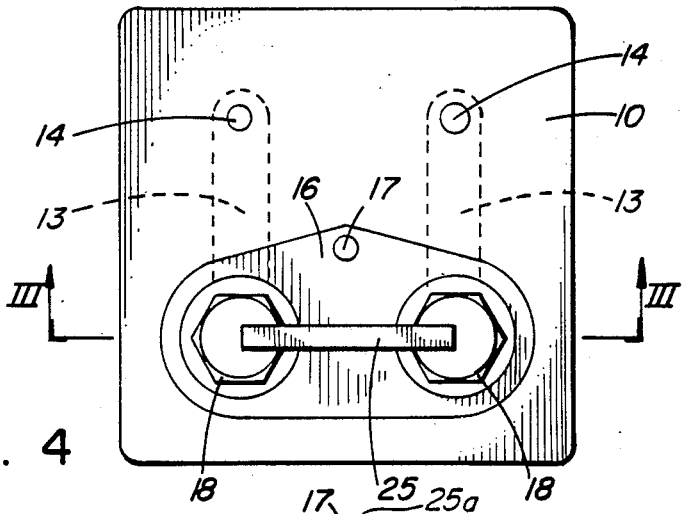
FIG. 4 is a plan view of the embodiment illustrated in FIG. 3.

FIGS. 3 and 4 illustrate a very simple straight-forward arrangement. After the caps 18 have been screwed in, a bar 25 is attached to the caps. This can be attached by welding or other means. The bar 25 need not necessarily be attached to the top surface of the caps, but could be attached to a side surface. Various ways of so interconnecting the caps can readily be realized.

Figure 5:
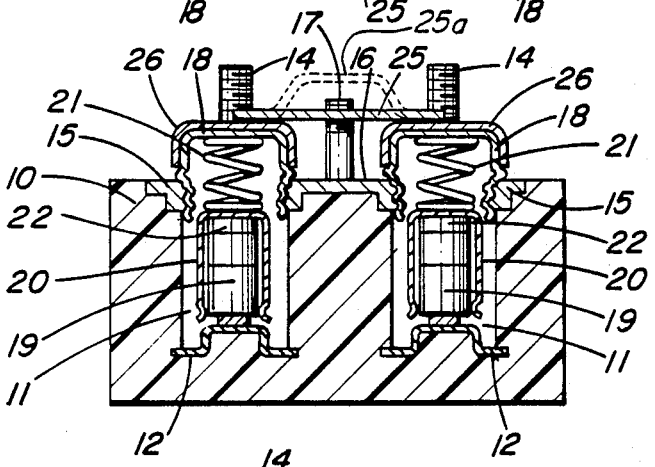
FIGS. 5 and 6 are cross-section and plan view, respectively, illustrating a further embodiment.
Figure 6:
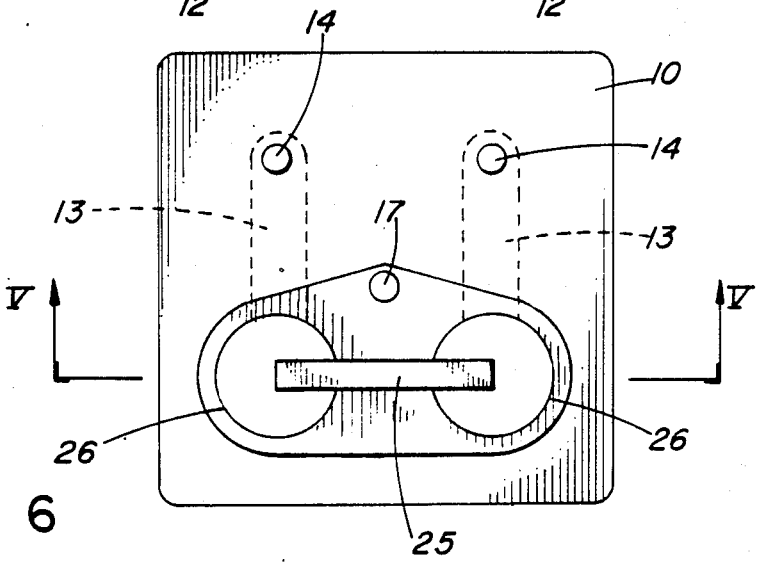

FIGS. 5 and 6 illustrate a modification, using a bar 25 as in FIGS. 3 and 4 but the bar is attached to two cap members 26 which fit over the caps 25. In the arrangement of FIGS. 3 and 4 the bar is attached after the caps 18 have been screwed in and this could be inconvenient, particularly for instalment in the field. In the arrangement of FIGS. 5 and 6, the bar 25 is supplied connected or attached to the cap members 26. After screwing the caps in, the cap members are pushed over the caps. The cap members are attached to the caps by bonding, for example. The bonding material can be put into the cap members immediately prior to fitting over the caps. Alternatively, the bonding material can be placed in the cap members at manufacture. The material, a suitable epoxy resin for example, can be retained in place by a paper or other diaphragm positioned on the open end of the cap member and removed prior to positioning the cap members. A modification, not illustrated, is for the cap members 26 and the bar 25 to be formed as a single unit, as by stamping or pressing.

Figure 7:
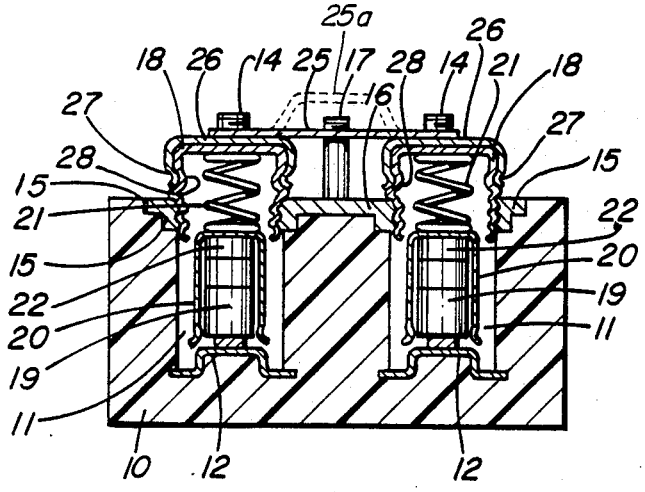
FIGS. 7 and 8 are cross-section and plan view, respectively, illustrating another embodiment.
Figure 8:
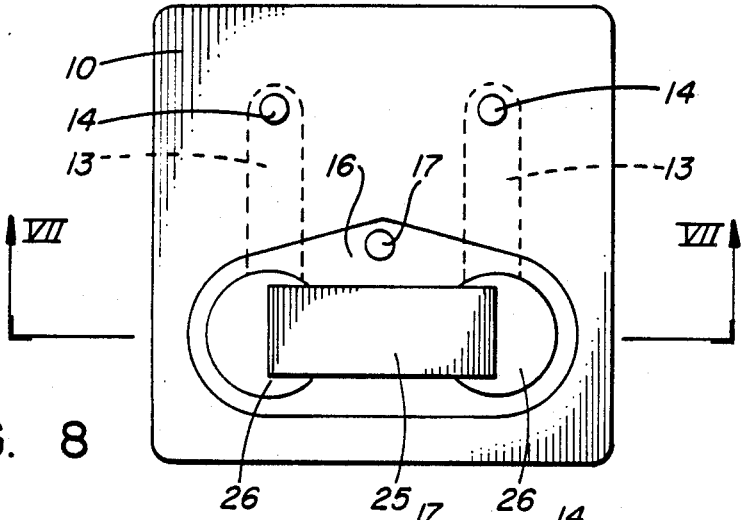

FIGS. 7 and 8 illustrate an arrangement in which the cap members 26 are crimped into a formation on the cap. Thus, as shown, the cap members can be crimped, at or near the bottom edge for example, at 27, into a groove 28 in the cap. The bar 25 is again attached to the cap members prior to use. In this example, or embodiment, the bar 25 is shown as much wider than in the embodiments of FIGS. 3 and 4 and FIGS. 5 and 6. This increases the resistance to breakage by anyone wanting to interfere with the protector.

Figure 9:
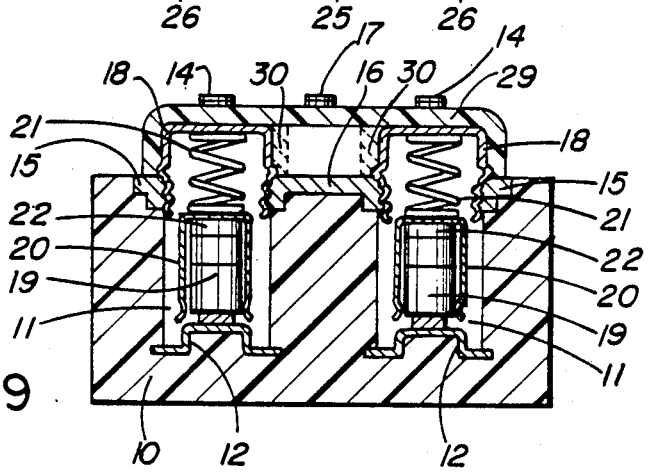
FIGS. 9 and 10 are cross-section and plan view, respectively, illustrating yet a further embodiment.
Figure 10:
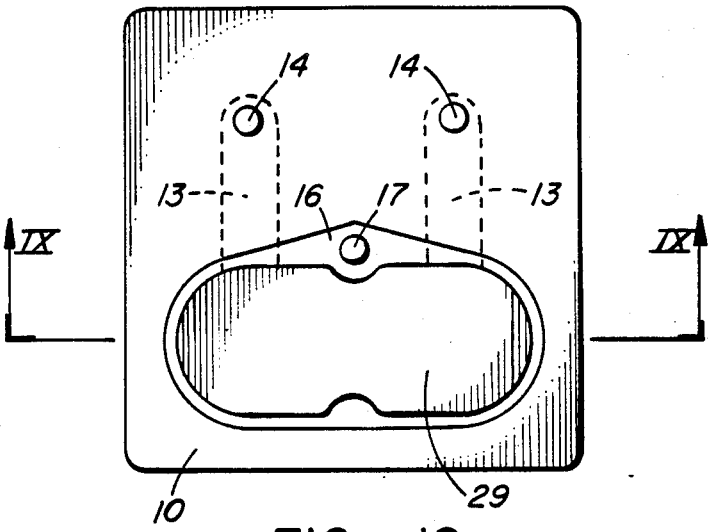

FIGS. 9 and 10 illustrate an arrangement in which the caps 18 are enclosed in a single cap member 29 which fits over both caps. The cap member 29 can be a plastic molding, a metal molding, a metal stamping, or other form. In the example shown in FIGS. 9 and 10, the cap member 29 is semi-cylindrical at each end. That is, the cap member extends for about half the circumference of each cap. The cap member can be bonded in place, or if a thin wall stamping can be crimped in place, somewhat as in FIGS. 7 and 8. The cap member can be made with a complete cylinder formation at each end, which encompasses completely each cap 18, as indicated by dotted lines 30.

The arrangement of FIGS. 3 and 4, FIGS. 5 and 6, and FIGS. 7 and 8 provide for easy replacement by service personnel. To replace an arrestor, the bar 25 is cut, the caps of both arrestors unscrewed, the faulty arrestor replaced and new caps inserted. The bar 25 is then attached, in an arrangement as in FIGS. 3 and 4, while a cap member assembly is applied in an arrangement as in FIGS. 5 and 6 and FIGS. 7 and 8. The bar 25 in FIGS. 7 and 8 can still readily be cut by a service person. In the arrangement of FIGS. 9 and 10 it will be necessary to remove a portion of the cap member 29, as by making two cuts across the cap member, close to each cap.

Various variations in and modifications to the examples illustrated in FIGS. 3 to 10 can be made. Taking the example illustrated in FIGS. 9 and 10, and in particular the form having complete cylindrical formations at each end, while one cylindrical formation can be circular, or similar cross-section, the other formation can be of oval or somewhat elongate cross-section to permit for some variance in center to center distance of arrestor caps. This can arise because of differing arrestor well spacing in different protectors. Such variation in spacing, or pitch, of arrestors can also be accommodated in other examples. Thus, for example, in the arrangements of FIGS. 5 and 6 and FIGS. 7 and 8, the connecting bar 25 can be made such that it can be bent into a loop to bring the cap members closer together. Alternatively, the bar 25 can be made initially with a loop or bend in it, which can be flattened to a varying degree to increase the pitch of the cap members. Such a bend or loop is indicated by dotted lines **25*a* in FIGS. 5 and 7. It is possible to make the bar 25** of flexible material which will readily bend, but prevent relative rotation.

Figure 11:
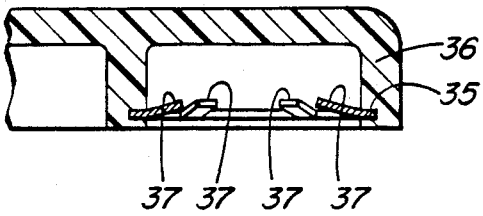
FIG. 11 is a cross-section through an end of a cap member similar to that in FIG. 9, illustrating a modification to the cap member.

It is also possible to use metal washers having spring tangs which are forced into either a screw cap, or a cap member, or both, on positioning a cap member on a screw cap. Thus, considering FIG. 11 for example, which can be considered as being one end of the arrangement in FIGS. 9 and 10, with a complete cylindrical formation, a steel washer 35 is molded in close to the open end of the cylindrical formation 36. As the cap member 29 is pushed on, the screw cap would push up the radially inwardly extending tangs 37. Once in position, any attempt to pull off the cap member would cause the tangs 37 to dig into the screw cap.

Similar metal washers having both inwardly and outwardly radially extending tangs can be used. By this means, once a cap member is in position, the tangs engage with both the screw cap and cap member. Other arrangements using such washers, or other forms of gripping members can readily be envisaged.

What is claimed is:

1. Apparatus for providing positive protection for station protectors for telephone systems, by at least restricting access to an arrestor in the protector and indicating any such access, comprising a unitary connecting means interconnecting adjacent screw caps of a pair of arrestor positions in a protector, said connecting means preventing turning of either of said screw caps without breaking of said connecting means.

2. Apparatus for providing positive protection for station protectors for telephone systems, by at least restricting access to an arrestor in the protector and indicating any such access, comprising: connecting means interconnecting adjacent screw caps of a pair of arrestor positions in a protector, said connecting means preventing turning of either of said screw caps without breaking said connecting means, said connecting means being permanently attached to said screw caps.

3. Apparatus for providing positive protection for station protectors for telephone systems, by at least restricting access to an arrestor in the protector and indicating any such access, comprising: connecting means interconnecting adjacent screw caps of a pair of arrestor positions in a protector, said connecting means preventing turning of either of said screw caps without breaking said connecting means, said connecting means comprisng a metal bar attached to said screw caps.

4. Apparatus for providing positive protection for station protectors for telephone systems, by at least restricting access to an arrestor in the protector and indicating any such access, comprising: connecting means interconnecting adjacent screw caps of a pair of arrestor positions in a protector, said connecting means preventing turning of either of said screw caps without breaking said connecting means, said connecting means comprising a cap member positioned over each screw cap, and connected thereto, and means connecting the cap members.

5. Apparatus as claimed in claim 4, said means connecting the cap members comprising a metal bar attached to said cap members.

6. Apparatus as claimed in claim 5, said metal bar attached to said cap members prior to positioning the cap members over said screw caps.

7. Apparatus as claimed in claim 4, said cap members being bonded to said screw caps.

8. Apparatus as claimed in claim 4, said cap members being connected to said screw caps by crimping.

9. Apparatus for providing positive protection for station protectors for telephone systems, by at least restricting access to an arrestor in the protector and indicating any such access, comprising: connecting means interconnecting adjacent screw caps of a pair of arrestor positions in a protector, said connecting means preventing turning of either of said screw caps without breaking said connecting means, said connecting means comprising a unitary cap member positioned over both screw caps of a pair of arrestor positions, said unitary member attached to said screw caps to prevent turning of one screw cap relative to the other.

10. Apparatus as claimed in claim 9, said unitary cap member being bonded to said screw caps.

11. Apparatus as claimed in claim 9, said unitary cap member having a hollow box-like formation, and having semi-cylindrical end walls engaging with said screw caps.

12. Apparatus as claimed in claim 9, said unitary cap member having a cylindrical recess at each end, said screw caps being positioned in said cylindrical recesses.

13. A station protector including apparatus for providing positive protection by at least restricting access to an arrestor in the protector and indicating any such access, said station protector comprising:

a housing;

a pair of wells in said housing, extending from a surface of the housing;

a line contact member in each well, remote from said surface;

a threaded ring in each well at said surface, said nhreaded ring forming a ground connection;

an arrestor in each well, one end of the arrestor in electrical contact with said line contact member;

a screw cap screwed into each of said threaded rings, the screw caps in electrical connection with the other end of said arrestor;

a unitary connecting means interconnecting the screw caps of said pair of wells, said connecting means preventing turning of either of said screw caps without breaking of said connecting means.

14. A station protector including apparatus for providing positive protection by at least restricting access to an arrestor in the protector and indicating any such access, said station protector comprising:

a housing;

a pair of wells in said housing extending from a surface of the housing;

a line contact member in each well, remote from said surface;

a threaded ring in each well at said surface, said threaded ring forming a ground connection;

an arrestor in each well, one end of the arrestor in electrical contact with said line contact member;

a screw cap screwed into each of said threaded rings, the screw caps in electrical connection with the other end of said arrestor;

connecting means interconnecting the screw caps of said pair or wells, said connecting means preventing turning of either of said screw caps without breaking of said connecting means, and said connecting means comprising a metal bar attached to said screw caps.

15. A station protector including apparatus for providing positive protection by at least restricting access to an arrestor in the protector and indicating any such access, said station protector comprising:

a housing;

a pair of wells in said housing extending from a surface of the housing;

a line contact member in each well, remote from said surface;

a threaded ring in each well at said surface, said threaded ring forming a ground connection;

an arrestor in each well, one end of the arrestor in electrical contact with said line contact member;

a screw cap screwed into each of said threaded rings, the screw caps in electrical connection with the other end of said arrestor;

connecting means interconnecting the screw caps of said pair of wells, said connecting means preventing turning of either of said screw caps without breaking of said connecting means, and said connecting means comprising a cap member positioned over each screw cap and connected thereto, and means connecting the cap members.

16. A protector as claimed in claim 15, said means connecting the cap members comprising a metal bar attached to said cap members.

17. A protector as claimed in claim 15, said cap members being bonded to said screw caps.

18. A protector as claimed in claim 15, said cap members being connected to said screw cap by crimping.

19. A station protector including apparatus for providing positive protection by at least restricting access to an arrestor in the protector and indicating any such access, said station protector comprising:

a housing;

a pair of wells in said housing extending from a surface of the housing;

a line contact member in each well, remote from said surface;

a threaded ring in each well at said surface, said threaded ring forming a ground connection;

an arrestor in each well, one end of the arrestor in electrical contact with said line contact member;

a screw cap screwed into each of said threaded rings, the screw caps in electrical connection with the other end of said arrestor;

connecting means interconnecting the screw caps of said pair of wells, said connecting means preventing turning of either of said screw caps without breaking of said connecting means said connecting means comprising a unitary cap member positioned over both screw caps of a pair and attached to the screw caps to prevent relative turning of either screw caps.

20. A protector as claimed in claim 19, said unitary cap member having a hollow box-like formation and a semi-cylindrical wall at each end engaging with said screw caps.

21. A protector as claimed in claim 19, said unitary cap member having a cylindrical recess at each end, said screw caps being positioned in said cylindrical recesses.

22. A station protector including apparatus for providing positive protection by at least restricting access to an arrestor in the protector and indicating any such access, said station protection comprising:

a housing;

a pair of wells in said housing extending from a surface of the housing;

a line contact member in each well, remote from said surface;

a threaded ring in each well at said surface, said threaded ring forming a ground connection;

an arrestor in each well, one end of the arrestor in electrical contact with said line contact member;

a screw cap screwed into each of said threaded rings, the screw caps in electrical connection with the other end of said arrestor;

connecting means interconnecting the screw caps of said pair of wells, said connecting means preventing turning of either of said screw caps without breaking of said connecting means, and said connecting means including a metal washer having a deformable spring tangs extending radially, said tangs engaging said screw caps.

23. Apparatus as claimed in claim 22, said connecting means further including a cap member positioned over a screw cap, said washer extending between said cap member and said screw cap, said tangs engaging with at least one of said cap member and said screw cap.

24. Apparatus as claimed in claim 23, said washer including spring tangs extending radially inwards and radially outwards, said tangs engaging with both said cap member and said screw cap.

* * * * *